US006540558B1

(12) United States Patent
Paagman

(10) Patent No.: US 6,540,558 B1
(45) Date of Patent: Apr. 1, 2003

(54) CONNECTOR, PREFERABLY A RIGHT ANGLE CONNECTOR, WITH INTEGRATED PCB ASSEMBLY

(75) Inventor: Bernardus L. F. Paagman, Schijndel (NL)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 08/973,811

(22) PCT Filed: Jul. 2, 1996

(86) PCT No.: PCT/US96/11214

§ 371 (c)(1),
(2), (4) Date: Dec. 9, 1997

(87) PCT Pub. No.: WO97/02627

PCT Pub. Date: Jan. 23, 1997

(30) Foreign Application Priority Data

Jul. 3, 1995 (EP) ..... 95201811

(51) Int. Cl.[7] ..... H01R 13/648
(52) U.S. Cl. ..... 439/608
(58) Field of Search ..... 439/101, 108, 439/608, 79, 65, 95, 607, 609, 680, 681

(56) References Cited

U.S. PATENT DOCUMENTS

| | | | | |
|---|---|---|---|---|
| 3,035,244 A | | 5/1962 | Aveni | 339/156 |
| 3,208,028 A | | 9/1965 | Mittler et al. | 339/18 |
| 3,432,801 A | | 3/1969 | Ruotolo | 339/126 |
| 3,564,343 A | | 2/1971 | Guest et al. | 317/101 |
| 4,008,941 A | | 2/1977 | Smith | 339/17 LC |
| 4,017,770 A | | 4/1977 | Valfre | 361/399 |
| 4,148,543 A | | 4/1979 | Shores | 339/143 R |
| 4,157,612 A | | 6/1979 | Rainal | 29/628 |
| 4,206,963 A | | 6/1980 | English et al. | 339/147 |
| 4,211,466 A | | 7/1980 | Reynolds | 339/176 MF |
| 4,265,549 A | | 5/1981 | Cote | 400/124 |
| 4,331,370 A | | 5/1982 | Andrews et al. | 339/17 M |
| 4,382,653 A | | 5/1983 | Blanchard | 339/143 R |
| 4,457,574 A | | 7/1984 | Walters | 339/143 R |
| 4,477,022 A | | 10/1984 | Shuey et al. | 339/59 M |
| 4,571,014 A | | 2/1986 | Robin et al. | 339/14 R |
| 4,846,727 A | | 7/1989 | Glover et al. | 439/608 |
| 4,979,903 A | | 12/1990 | Gosselin | 439/78 |
| 5,066,236 A | | 11/1991 | Broeksteeg | 439/79 |
| 5,104,341 A | | 4/1992 | Gilissen et al. | 439/608 |
| 5,169,343 A | | 12/1992 | Andrews | 439/608 |
| 5,174,770 A | | 12/1992 | Sasaki et al. | 439/108 |
| 5,429,520 A | | 7/1995 | Morlion et al. | 439/108 |
| 5,479,321 A | | 12/1995 | Mair et al. | 369/816 |
| 5,490,787 A | * | 2/1996 | Bowman et al. | 439/79 |
| 5,522,727 A | | 6/1996 | Saito et al. | 439/65 |
| 5,795,191 A | * | 8/1998 | Preputnick et al. | 439/108 |

FOREIGN PATENT DOCUMENTS

| | | | |
|---|---|---|---|
| EP | 0 442 643 B1 | 2/1991 | H01R/23/68 |
| JP | 6-177497 | 6/1994 | |

OTHER PUBLICATIONS

IBM Technical Disclosure Bulletin—Shielded In–Line Electrical Multiconnector vol. 10 No. 3 Aug. 1976.

European Search Report dated Nov. 1995 for application EP 95 20 1811.

* cited by examiner

*Primary Examiner*—P. Austin Bradley
*Assistant Examiner*—Briggitte Hammond

(57) ABSTRACT

A connector, comprising one or more integrated PCB assemblies, each of said PCB assemblies comprising an insulating substrate, a cover plate and optionally a spacer each of said insulating substrates (16) comprising a predetermined pattern of conductive tracks (11) on a first surface, each of said conducting tracks (11) having one end for connection to one first contact terminal (4), and another end for connection to one second contact terminal (7) recesses are provided between the substrate and the cover with a first set of one or more first recesses (24) arranged for accommodating at least part of one first contact terminal (4) and with a second set of one or more second recesses (25) arranged for accommodating at least part of one second contact terminal (7).

40 Claims, 11 Drawing Sheets

30
62
35
56

62
IIXD
48
IIXD
59
69
IIXC
IIXC

IIXB
IIXA
IIXA
IIXB
34
58
37

57
38
31
34
34
58

63
31
64
65
66

63
59
31
35
65
60

CONNECTOR, PREFERABLY A RIGHT ANGLE CONNECTOR, WITH INTEGRATED PCB ASSEMBLY

BACKGROUND OF THE INVENTION

1. Field of the Invention

The present invention relates to connectors and specifically to high speed, shielded connectors having one or more integrated PCB assemblies.

2. Brief Description of Prior Developments

Right angle connectors are now widely used and available in many different configurations. For right angle connector structures, the usual method of manufacture comprises stitching terminals into a suitable housing followed by row-by-row tail bending of the terminal tails. However, the method of bending the tails of each of the terminals is complex, especially since the bending is different for each row. The bending for each row must be done in such a way that each of the board contact terminals extends substantially the same distance from the connector body. Moreover, each of said board contact terminals, in the assembled state of the connector, must be precisely positioned in such a way that the pattern of board contact terminals corresponds closely to the pattern of holes in the PCB into which they will be inserted. An additional difficulty is related to the EMI shielding of the tails for high-frequency applications. In particular for the latter difficulty, a controlled-impedance tail section is preferred with additional ground shielding options. Towards this end, it is known to subdivide the manufacture of such a connector into one part for accommodating contact terminals for mating contact with the contact terminal of a mating connector and a separate for the tail end. Separate shielding casings, if required in a right angled configuration, may be provided around each of the terminals within the connector. Although connectors manufactured in this way operate satisfactorily the manufacturing costs are high.

U.S. Pat. No. 4,571,014 shows a different approach for the manufacturing of right angle connectors using one or more PCB assemblies. Each of the PCB assemblies comprises one insulated substrate, one spacer, and one cover plate, all of which are attached to one another. The insulating substrate is provided with a predetermined pattern of conducting tracks, while ground tracks are provided between the conducting tracks. The conducting tracks are connected at one end to a female contact terminal and at the other end to a male contact terminal. Each of the cover plates is a conductive shield member.

In the arrangement according to U.S. Pat. No. 4,571,014, the insulating substrates are rather thick to allow plated blind holes to be made for the construction of female-type contacts for mating contact with male-type pins of a mating connector or the like. The female contacts are connected to conducting tracks on the surface of the insulating substrate through a thin metal tail extending from the plated blind hole through the material of the insulating substrate to the corresponding track. However, in practice it is very difficult to produce such constructions with thin metal tails in a cost effective and reliable way. Moreover, it is practically very difficult to produce deep plated blind holes having a plating of a uniform thickness. Because of the application of plated blind holes within the insulating substrates each of the printed circuit boards has to have a predetermined thickness which reduces the possibilities of miniaturization.

Another disadvantage of the connector known from this U.S. Pat. No. 4,571,014 is that the shield members, the insulating substrates and the spacers have to be aligned with small holes and are fixed to one another by conducting rivets or pins through the aligned holes; the holes in the insulating substrates are plated through-holes, thus establishing an electrical contact between each of the ground tracks between the conducting tracks and the shield members in the assembled state. However, in practice this is not a very reliable way of assuring electrical contact between the shield members and the ground tracks on the insulating substrates.

SUMMARY OF THE INVENTION

The object of the present invention is to provide a connector which overcomes the disadvantages described above.

This object is obtained by the present invention by providing a connector in which terminals are secured onto the surface of a PCB carrying a conductive trace. The portion of the terminal extending above the surface of the PCB is accommodated by recesses formed in an associated cover or in a spacer. By the arrangement of such a first set of one or more first recesses and a second set of one or more second recesses respective first and second contact terminals, either male or female, can be easily connected to the respective conducting tracks. No complicated plated blind holes are necessary to make female-type contact terminals since the recesses in the cover or the spacer provide enough space for accommodating formed contact terminals, such as a male or female terminal blanked from sheet stock.

In order to provide shielding between adjacent conducting tracks on the PCB, ground tracks may be provided between the conducting tracks on a first surface and a ground layer may be provided on a second surface opposite the first surface.

The cover plates are made of insulating material and may be provided with cover plate conducting tracks and cover plate ground tracks in a predetermined pattern on a first cover plate surface facing the insulating substrate. The cover plate conducting tracks may have one end for connection to one first contact terminal and another end for connection to one second contact terminal. The cover plates may have the second cover plate surface opposite said first cover plate surface covered by a cover plate ground layer. Thus, each of the first contact terminals may be connected to one second contact terminal through one conducting track on the insulating substrate and through a conducting track on the cover plate. Thereby, the electrical resistance between a first contact terminal and a respective second contact terminal is reduced. The pattern of conducting tracks on the insulating substrate and the pattern of conducting tracks on the cover plate may be in mirror relation to each other.

The ground tracks on the insulating substrate and the cover plate ground tracks on the cover plate, respectively, can be connected to the ground layer on the second surface of the insulating substrate and to the cover plate ground layer, respectively, through plated through-holes. This can be easily achieved, by starting the production of a connector according to the invention with an insulating substrate having metal layers at both sides. One side of the substrate is, then, patterned to be provided with suitable conducting tracks and ground tracks in a predetermined pattern, in accordance with known PCB manufacturing techniques. The ground tracks may then be electrically connected to the metal layer at the opposite side by plated through-holes, which can be made by well known manufacturing techniques.

The recesses in the spacer or cover plate can be designed for entirely accommodating one first contact terminal in such a way that, in the assembled state, none of the first contact terminals extends outside the connector. Such a configuration, used in conjunction with a shielding ground layer, provides improved shielding as it is possible to enclose each of the contact terminals to a greater extent.

The second contact terminals may comprise press-fit pins, surface mount terminals and solder contact pins for connecting the connector to a printed circuit board or the like.

The connector may also comprise an insulating connector body accommodating each of said one or more integrated PCB assemblies and provided with a metallized shielding layer on its outer surface. Thereby, the electromagnetic interference caused by such a connector to the environment is further reduced. The connector body desirably includes structure for receiving and securing PCB modules in alignment.

A simplified configuration results when in the connector according to the invention each spacer and its adjacent cover plate are substituted by another cover plate, provided with suitable recesses for accommodating first contact terminals and/or second contact terminals.

According to another feature of the invention, the PCB modules include planar insulating substrates having conductive traces on which terminals are secured and insulating covers disposed over the terminal carrying side of the substrate, the covers having recesses for accommodating the terminals. The covers and associated recesses can comprise a means of applying a force to the contact terminals, such as an insertion force necessary to press fit the connector into a circuit board, in a manner that minimizes or eliminates the imposition of stresses on the connection of the terminals to the circuit traces. The terminals include structure, engaged by the cover, for imparting force to the terminals.

The connector may be provided with suitable filter elements by arranging at least one electrical component within the connector, for instance selected from the group of components comprising resistors, capacitors and inductors.

The present invention will be further illustrated with reference to some drawings which are meant for illustration purposes only and not intended to limit the scope of the present invention.

In the drawings:

It is to be understood that although the figures illustrate right angle connectors, the principles of the present invention equally apply to other connector configurations.

DETAILED DESCRIPTION OF THE PREFERRED EMBODIMENTS

Figure 1:
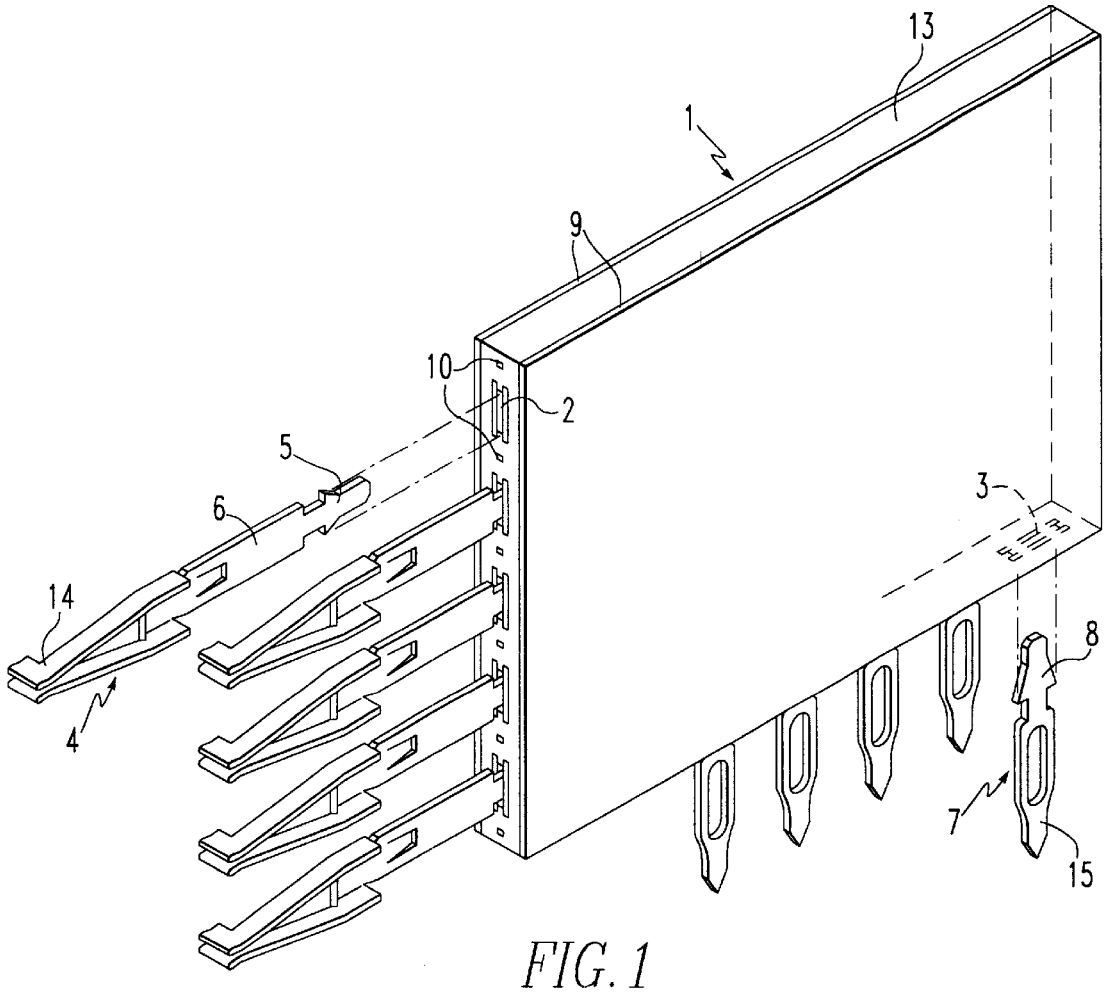
FIG. 1 schematically shows a connector in order to illustrate the principles of the present invention.

FIG. 1 shows an integrated PCB assembly 1 having an insulating body 13. The insulating body 13 may comprise two or more layers as explained below and may be provided with shielding ground layers 9 at either main outer surface. However, depending on the application one of the shielding ground layers, or both, may be omitted.

The body 13 is provided with a first series of openings or recesses 2 in a first side surface for accommodating suitable contact terminals 4. At a second side surface, the body 13 is provided with similar openings or recesses 3 for accommodating suitable board contact terminals 7. Each of said openings or recesses 2 and 3 includes a conductive surface therein. The recess 2 and 3 may be entirely or partly metallized.

Each of the contact terminals 4 is shown to have a female type contact portion 14, a tail connect portion 6 and a body connect portion 5. Each of the body connect portions 5 is designed to be received by one of the recesses 2 and to be electrically connected to the metal layer within the hole 2, e.g. by soldering or a press-fit connection.

If desired, each of the female-type contact portions 14 may be substituted by male-type contact portions or hermaphrodite-type contact portions, as is known to any person skilled in the art.

Each of the board contact terminals 7 is shown to have a board contact portion 15 and a body connect portion 8. Each of the body connect portions 8 is to be received by one recess 3 and to be connected e.g. by soldering or by a press-fit connection thereto. Each of the board contact portions 15 is designed to be received by an appropriate hole in a printed circuit board and to be connected thereto,. e.g. by soldering. However, a press-fit connection, as shown, can also be provided instead. As a further alternative, the board contact portion 15 may be designed to be suitable for surface mount or through mount connection to a printed circuit board. It is observed that the phrase "printed circuit board" is not used in a limiting sense, but is meant to include any kind of substrate to which connectors and right angle connectors may be connected, as is known by a person skilled in the art.

Each of the recesses 2 are electrically connected to a corresponding recesses 3 by suitable conducting means within the body 13. These suitable conducting means may be conductive traces 11 as will be explained below by reference to FIGS. 2*a* and 3*a*.

In order to provide a shielding effect between adjacent conducting means 11 within the body 13, ground tracks 10 may be provided in-between. Instead of providing a ground track 10 between each two adjacent conducting means 11 other configurations are possible. Ground tracks 10 may, e.g., be present between adjacent groups of two conducting means 11 thus having a twinax-type configuration.

Figure 2A:
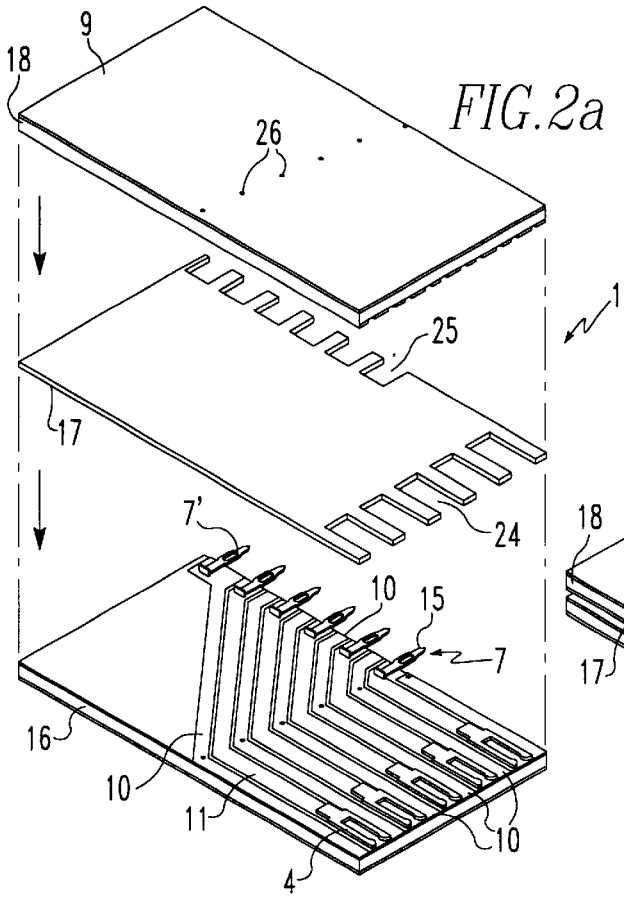
FIGS. 2*a*–2*c* show a right angle connector manufactured in accordance with the invention.
Figure 2B:
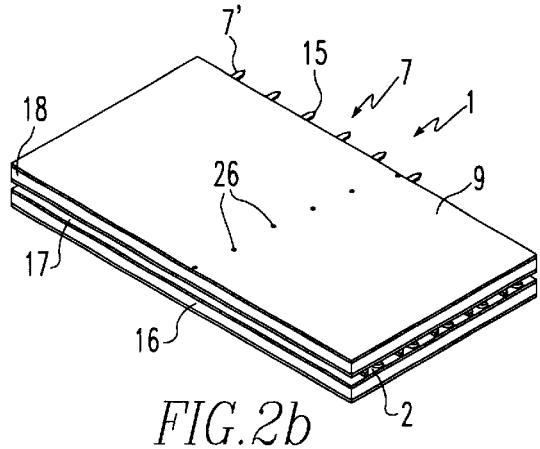
Figure 2C:
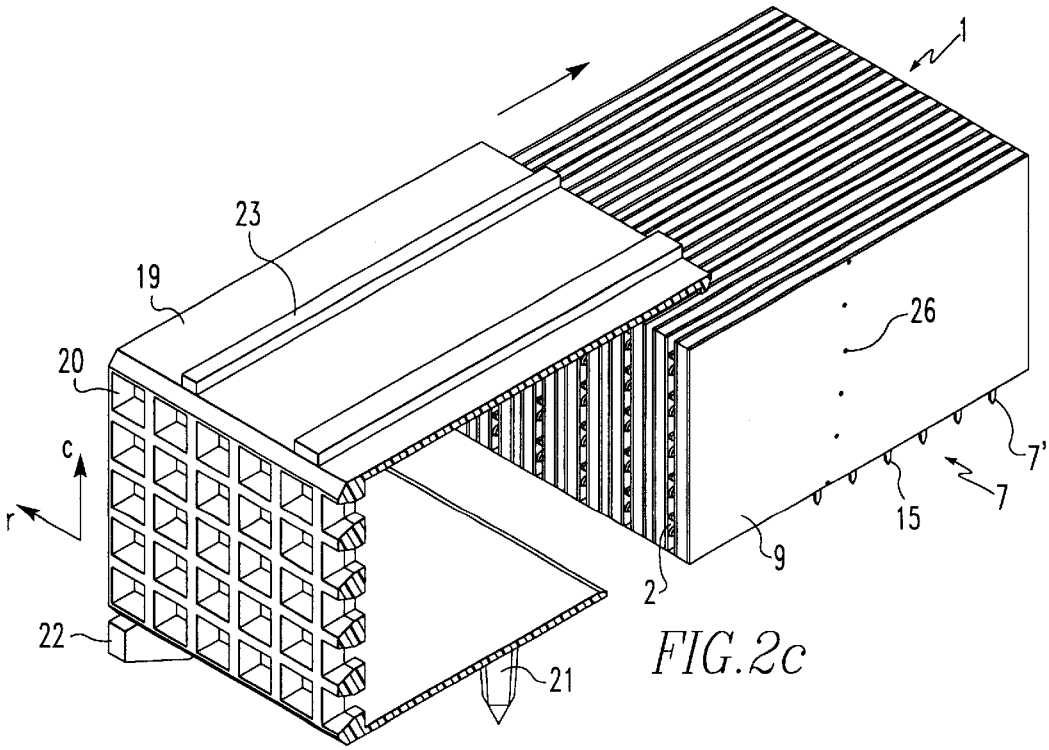

FIGS. 2*a* through 2*c* show subsequent manufacturing steps of producing a right angle connector according to the invention in which standard methods of producing printed circuit boards are used.

FIG. 2*a* shows an insulating substrate 16, formed for example of conventional flat PCB material provided with several parallel conducting tracks 11. Conducting ground tracks 10 may be provided between adjacent conducting tracks 11. The outer most conducting ground track 10 is provided with a ground contact terminal 7' to be connected to ground through the printed circuit board to which the connector is to be connected. Methods of producing an insulating substrate 16 with parallel conducting tracks 10, 11 are widely known in the field of manufacturing printed circuit boards and need not be explained here.

Each of the conducting tracks 11 is connected to board contact terminals 7, the board contact portions 15 of which extending beyond the insulating substrate 16. Although the board contact portions 15 are shown as press-fit terminals they might be replaced by suitable solder tail terminals or surface mount terminals as mentioned above.

The other ends of the conducting tracks 11 are connected to suitable contact terminals 4 which, in the embodiment shown in FIGS. 2*a* through 2*c*, do not extend beyond the insulating substrate 16.

Preferably, the body contact portions 5 and 8 of terminals 4 and 7, respectively are fixed onto suitable solder pads formed at the ends of traces 11. This can be achieved by conventional surface mount soldering techniques.

An insulating spacer 17 is provided having a first series of openings 24 for accommodating the contact terminals 4 and a second series of openings 25 for accommodating at least part of the board contact terminals 7. The recess 2 and 3 in the insulating body 13 are formed at the interface of adjacent layers or laminations. That is, the recesses 2, for example, are bounded by the insulating layer 16, the edges of openings 24 or 25 and the cover 18. This allows the contacts to be secured on layer 16 by conventional surface mounting or other bonding techniques.

An insulating cover plate 18, optionally provided with a fully metallized ground layer 9, is provided.

To reduce the electrical resistance between each of the contact terminals 4 and the board contact terminals 7 each of the insulating cover plates 18 may be provided with suitable conducting tracks 11 one end of which is electrically connected to a contact terminal 4 and the other end of which is electrically connected to a board contact terminal 7. These conducting tracks may be provided in a mirrored relation to the conducting tracks 11 on the insulating substrate 16. Cover plate 18 may also be provided with ground tracks 10 between those conducting tracks 11 (not shown). These ground tracks 10 are preferably connected to the ground layer 9 by means of plated through-holes 26. The manufacturing of plated through-holes is known to persons skilled in the art and need no further explanation. Of course, substrate 16 may be provided with similar plated through-holes 26 in order to connect ground tracks 10 to ground layer 9 at the outer surface of substrate 16.

FIG. 2*b* shows one integrated PCB assembly manufactured from the components shown in FIG. 2*a*, i.e. an insulating substrate 16 to which an insulating spacer 17 is attached and an insulating cover plate 18 attached to the insulating spacer 17. The first series of openings 24 in the insulating spacer 17 form recesses 2, in which the female-type contact terminals 4 are disposed to receive contact terminals of a mating connector (not shown). It is to be understood that the female-type contact terminals 4 shown in FIG. 2*a* may be replaced by male-type or hermaphrodite-type contact terminals.

Instead of providing both a spacer and a cover plate 18, only a cover plate could be provided in which suitable recesses are made for accommodating the contact terminals 4 and the board contact terminals 7. Such recesses would serve the same purpose as openings 24, 25 in spacer 17 shown in FIG. 2*a*. Alternatively, but less desirably from a cost standpoint, such recesses could be provided in substrate 16.

FIG. 2*c* shows several integrated PCB assemblies as shown in FIG. 2*b* parallel to each other and to be inserted into a connector body 19. The connector body 19 may be made of any insulating material and may be provided with a metallized outer surface to enhance the shielding effectiveness. The connector body 19 may be provided with suitable guiding ridges 23 and one or more guiding extensions 22 for properly connecting the assembled connector to a mating connector (not shown).

As is conventional, a locating and securing post 21, receivable within a hole in a printed circuit board to which the connector, is to be connected, is provided at the bottom side of the connector body 19. Preferably, each of the integrated PCB assemblies have at least one ground layer 9 on one of their main outer surfaces to shield the parallel integrated PCB assemblies from each other. Both outer surfaces of each of the outer integrated PCB assemblies in the configuration shown in FIG. 2*c* are preferably provided with ground layers 9 to enhance the shielding effectiveness.

The connector body 19 is provided with suitable lead-in holes 20 in corresponding relationship with each of the contact terminals 4. Each of the lead-in holes 20 is suitable for receiving a mating male-type contact terminal of a mating connector (not shown). The lead-in holes 20 are arranged in columns and rows as is designated by arrows c and r.

Figure 3A:
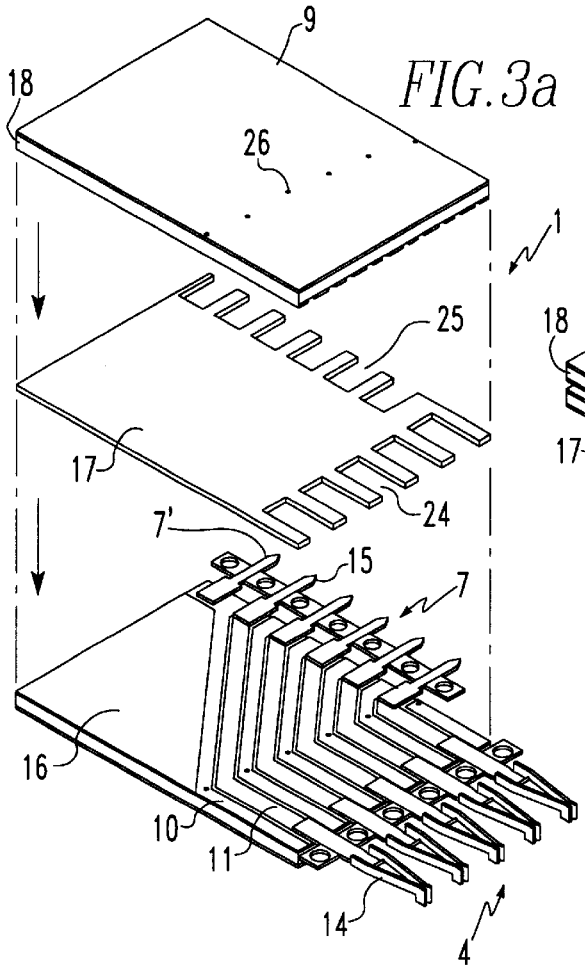
FIGS. 3*a* through 3*c* show a right angle connector according to an alternative method in accordance with the present invention.
Figure 3B:
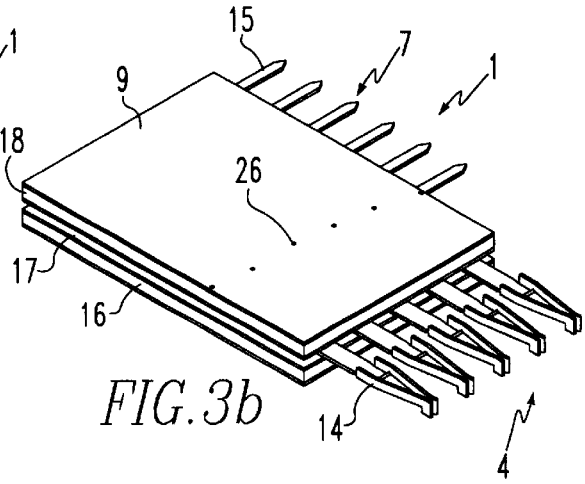
Figure 3C:
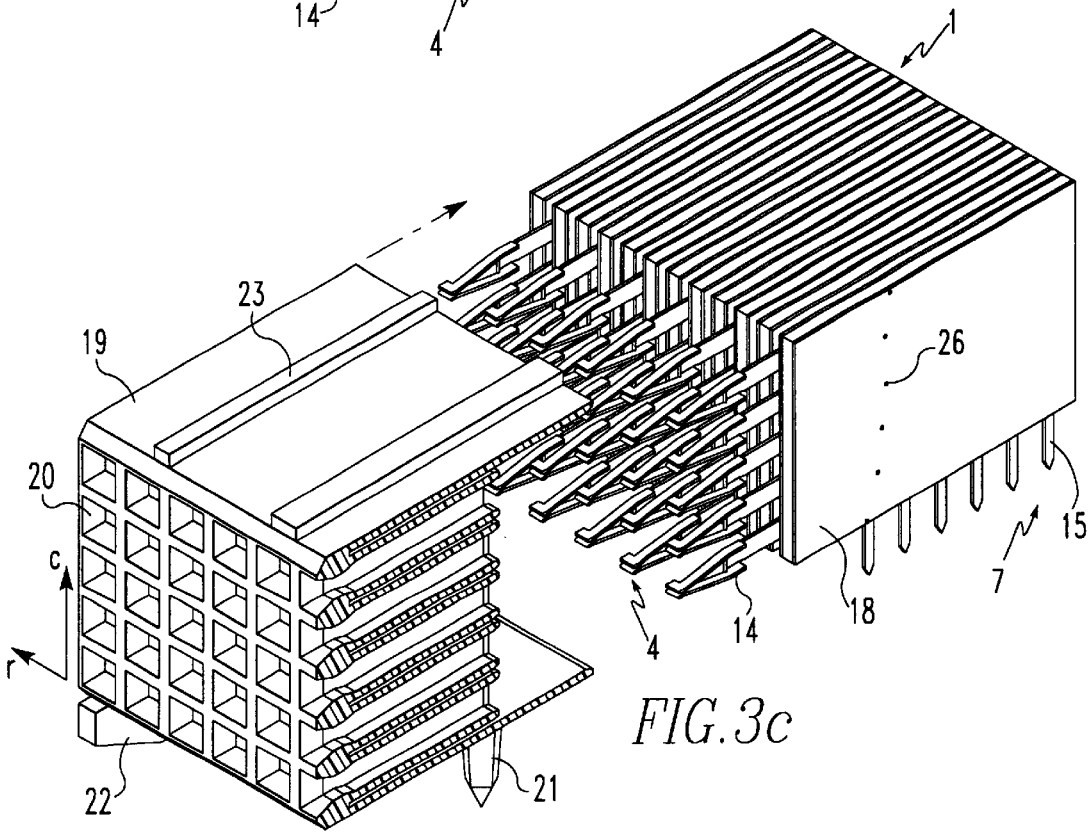

The main difference between the embodiments of FIGS. 2*a* through 2*c* and FIGS. 3*a* through 3*c* is that the contact terminals 4 in the embodiments of FIGS. 3*a* through 3*c* extend beyond the outer dimensions of the integrated PCB assembly.

In FIG. 3*a* several contact terminals 4 are shown adjoined on a carrier as one stamped part. The additional joining metal between adjacent contact terminals 4 is stamped away as a final step during manufacturing. The function of the carrier is to form a one stitch process.

Also board contact terminals 7 are shown to be adjoined on a carrier as one stamped part. The additional joining metal between adjacent board contact terminals is stamped away as final step during manufacturing.

Also here, the cover plate 18 may be provided with a plurality of suitable conducting tracks one side of which is to be connected electrically to one contact terminal 4 and the other side of which is to be connected to one board contact terminal 7 in order to reduce the electrical resistance.

Either or both of the insulating substrates 16 or the insulating cover plates 18 may be provided with a suitable ground layer 9.

The insulating substrate, the insulating spacer and the insulating cover plate are adhered to each other by widely known means like glue, conductive adhesives in track areas and/or use of pressure in order to produce one integrated PCB assembly as shown in FIG. 3*b*.

Like in the embodiment according to FIGS. 2*a*–2*c* spacer 17 could be omitted whereas, then, cover plate 18 could be provided with suitable recesses for accommodating those parts of contact terminals 4 and board contact terminals 7 not extending from substrate 16. Alternatively but less desirably, such recesses could be provided in substrate 16.

Several parallel integrated PCB assemblies as shown in FIG. 3*b* are introduced in the rear side of a connector body 19 which is provided with suitable openings in the rear side to accommodate the extending contact terminals 4 (FIG. 3*c*). When shielding between adjacent contact terminals 4 is required shielding means may be provided within the connector body 19. However, when shielding between contact terminals is desired, the embodiment according to FIGS. 2*a* through 2*c* may be preferred because it is easier to provide for shielding between adjacent contact terminals 4.

It is to be understood that the present invention is not limited to the embodiments shown in the figures. Especially, the invention is not limited to providing integrated PCB assemblies having one insulating substrate 16, one spacer 17 and one cover plate 18. Other numbers of substrates, spacers and cover plates are possible and are considered within the scope of the present invention. Moreover, the substrate 16, spacer 17 and cover plate 18 may have any desired dimension. Since separate substrates, spacers, cover plates, etc. may be used to manufacture connectors in accordance with the invention, filter elements, like resistors, capacitors and inductors, can be easily incorporated within the connector by using well known PCB manufacturing techniques. For example, they may be manufactured by well known thin film techniques.

Any of the insulating substrates 16 may, e.g., be provided with suitable connecting pins to be received by suitable holes in the insulating cover plates 18 to provide easier alignment of parallel integrated PCB assemblies and to prevent shifting of integrated PCB assemblies when inserting several parallel integrated PCB assemblies into the rear side of the connector body 19.

The connector according to the invention can be manufactured by using standard and inexpensive PCB manufacturing methods without the stamping/moulding/bending processes which are now widely used and which are relatively expensive. Moreover, impedance matching can be easily obtained since the manufacturing tolerances can be easily controlled. The connector according to the present invention can also be designed for miniature coaxial or twinax applications.

Although in the description presented above, the connector according to the invention is provided with a set of contact terminals 4 at one side and a set of board contact terminals 7 at another side it is to be understood that the principles of the invention also apply to connectors in which the board contact terminals 7 are substituted by contact terminals suitable for connection to a mating connector or the like. Moreover, the set of contact terminals 4 may be constructed as board contact terminals to be suited for connection to a printed circuit board or the like.

FIGS. 4–14*c* illustrate a second embodiment of an integral terminal PCB module. This embodiment eliminates the separate spacer element 17 of the previous embodiment and incorporates certain of its functions into a single cover/spacer member. The cover and an associated PCB terminal assembly form a terminal module, several of which can be held together in side-by-side relationship in a housing to form an electrical connector.

Figure 4:
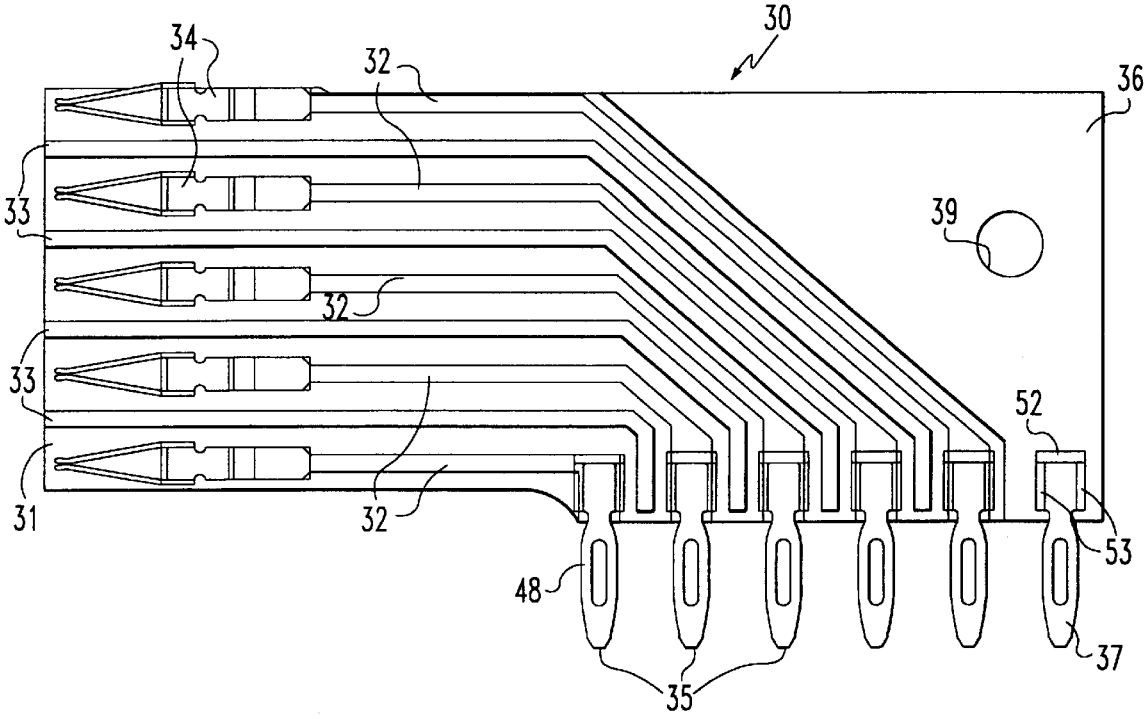
FIG. 4 is a side elevational view of a PCB assembly according to a second embodiment of the invention.

Referring to FIG. 4, the PCB assembly 30 comprises an insulating substrate 31 of a material commonly commercially used for making PCBs. The substrate 31 can be a resin impregnated fiber assembly such as is sold under the designation FR4, having a thickness 0.4 mm, for example. On a first surface of the substrate 31, a plurality of circuit traces 32 are formed by conventional PCB techniques. Each trace 32 extends from a first portion of the substrate 31, for example adjacent the front edge as shown in FIG. 4, to a second area or region of the substrate 31, such as the bottom edge as shown in FIG. 4. The traces 32 include contact pads at each end adapted to have metal terminals secured to them, as by conventional surface mounting techniques using solder. A plurality of ground or shielding traces 33 may also be applied to the substrate 31. The shielding traces 33 may be disposed between each of the circuit traces 32 or between groups of such traces. A terminal, such as a contact terminal 34 is mounted at the first end of each trace 32 and a connector mounting side terminal 35 is mounted on the second end of each circuit trace 32. An additional shielding or ground layer 36 may be applied to the remainder of the substrate 31. A ground terminal 37 is fixed onto the ground layer 36, in alignment with the terminals 35.

A locating hole 39 may be appropriately placed in the substrate 31. The locating hole 39 preferably comprises a plated through hole for establishing electrical connection with a grounding layer 38 (FIG. 5) that may extend substantially over the entire back surface of the substrate 31. As previously described, small vias forming plated through-holes may be disposed in each of the ground tracks 33 so that the ground tracks 33, the shield layer 36 and the back shield layer 38 form a shielding structure for the signal traces 33 and associated terminals.

Figure 5:
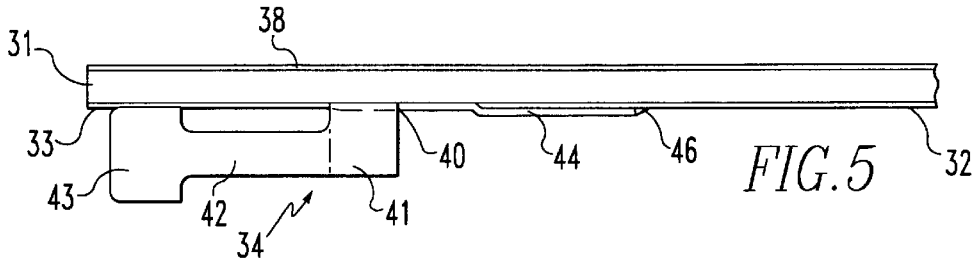
FIGS. 5, 6 and 7 are fragmentary views showing the mounting of terminals on the PCB assembly shown in FIG. 4.
Figure 6:
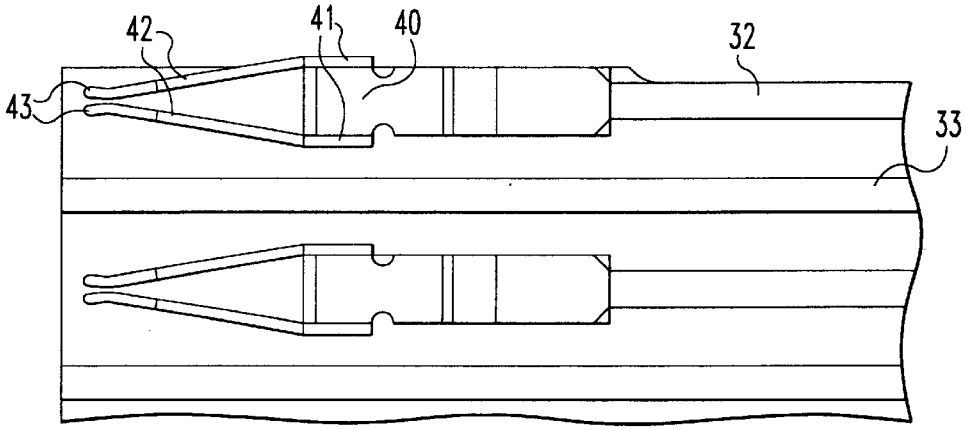

As shown in the fragmentary views of FIGS. 5 and 6, contact terminals 34 are formed as a one-piece stamping and can comprise a dual beam contact having a base section 40 having an opposed pair of upstanding portions 41. A spring section 42 is cantilevered from each of the upstanding portions 41 to define an insertion axis for a mating terminal, such as a pin from a pin header. Such a pin would be engaged by the contact portions 43 disposed at the end of each cantilevered arm 42. The contact terminals also include a mounting section, such as the planar member 44, that is adapted to be secured onto the end of the circuit trace 32, typically by solder 46. The latter can be accomplished by conventional surface mounting or other bonding techniques. As can be realized by the above description, the cantilevered arms 42 and contact portions 43 define a contact mating or pin insertion axis that is generally parallel to the plane of substrate 31, but is offset from the surface carrying the conductive traces 32.

Figure 7:
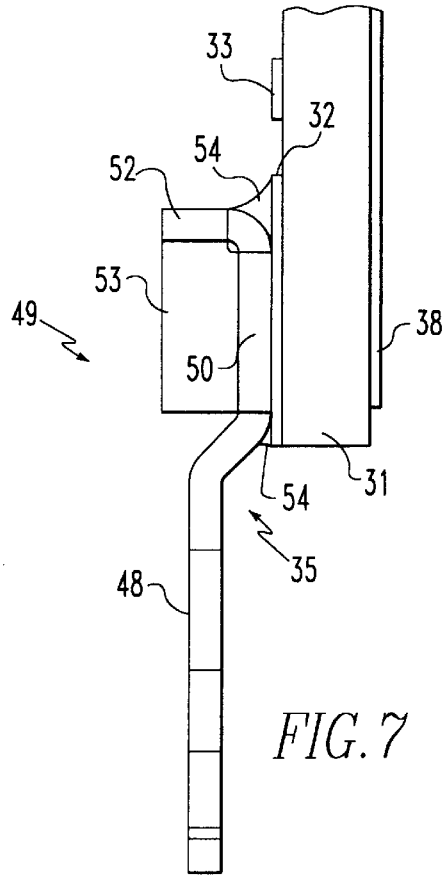
Figure 8D:
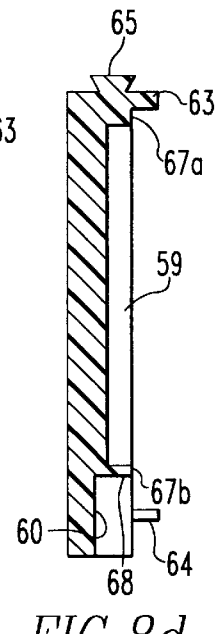
FIGS. 8–8*d* show different views of an insulative cover to be used in conjunction with the PCB assembly of FIG. 4 to form a terminal row module.
Figure 8C:
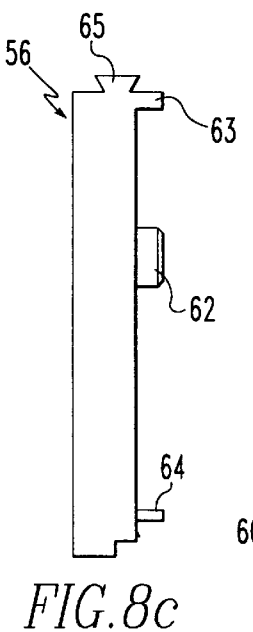
Figure 8:
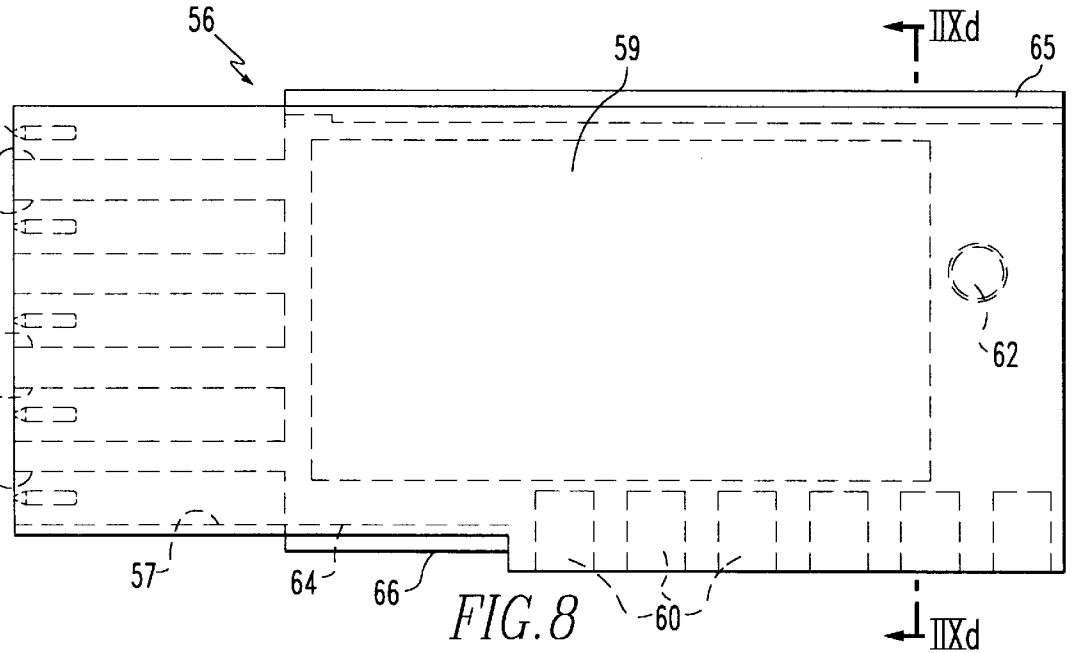
Figure 8B:
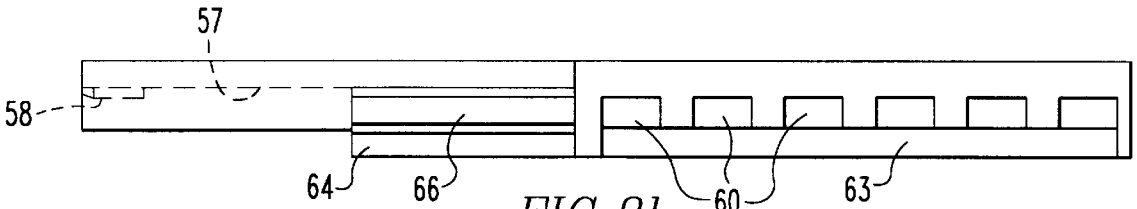
Figure 8A:
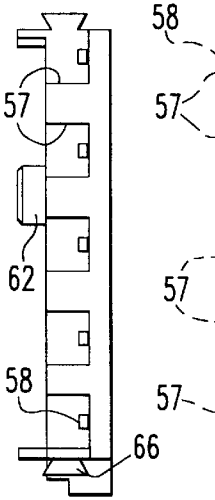

As illustrated in FIG. 7, one preferred form of connector mounting terminal 35 includes a press-fit section 48 and a board mounting section 49. The board mounting section 49 includes a generally planar base 50 with an upturned top tang 52 disposed along a top edge. A pair of opposed side tangs 53 are also upturned from the base 50. The mounting portion 49 is retained on the circuit trace 32 by solder fillets 54, again formed by conventional surface mounting solder techniques. Preferably, the top tang 52 is spaced closely adjacent to or rests on the top surfaces of the side tangs 53 as shown in FIG. 7.

FIGS. 8, 8*a*, 8*b*, 8*c* and 8*d* illustrate an insulative cover/spacer member 56, preferably molded from an appropriate polymeric insulating material. The cover includes a plurality of contact recesses 57 formed along one edge. Each of the recesses 38 includes a contact preload rib 58. A large central recess 59 may also be formed in the cover. A second plurality of terminal recesses 60 is formed along a second edge of the cover. Further, a locating boss 62 is integrally formed with the cover and is sized and shaped to be received, with limited clearance, in the locating opening 39 in the substrate 31. The cover further includes an upper rim 63 extending from the rear of the cover to a location near the recesses 57. A bottom rim or support member 64 is formed on a portion of the bottom surface of the cover. The cover 56 further includes an upper locating and mounting rib 65, preferably in the form of a dove tail rib as shown. A similar but shorter mounting and locating rib 66 is disposed on the bottom edge of the cover. The surfaces 67*a* and 67*b* form board rest surfaces against which a substrate 31 is placed. The surfaces 67*a* and 67*b* may carry an adhesive or alternately a double adhesive coated film (not shown) may be applied to extend from surface 67*a* to surface 67*b*.

Figures 9, 9A, 9B, 9C, 9D, 9E:
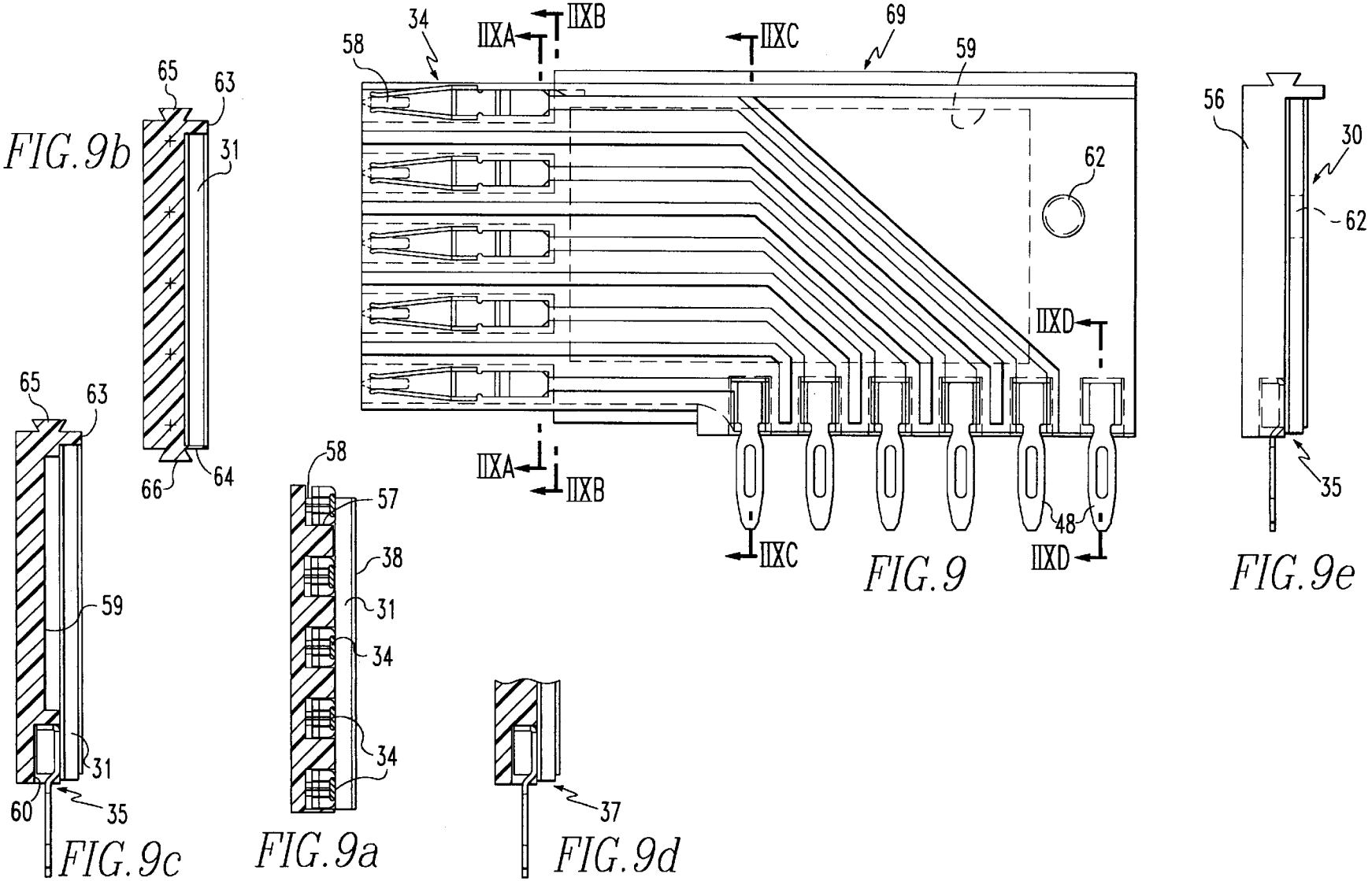
FIGS. 9–9*e* illustrate an assembled terminal module formed of a PCB assembly as shown in FIG. 4 and a cover as shown in FIG. 9.

A terminal module 69 (FIG. 9) is formed by associating a PCB terminal assembly 30 with a cover 56. FIG. 9 is substantially an x-ray view through the cover 56 for ease in showing the location of the elements on substrate 31, with respect to the cover. The PCB assembly 30 is located in the vertical direction by the upper and lower rim or mounting members 63, 64 and is located in a longitudinal manner by the locating boss 62. The contact terminals 34 are located in the contact recesses 57 and the connector mounting terminals 35 are located in the recesses 60. The previously mentioned adhesive or adhesive coated films on surface 67*a* and 67*b* maintain the PCB assembly and cover 56 together.

FIG. 9*a* is a sectional view taken along line AA of FIG. 9 and shows the contact terminals 34 located in the contact recesses 57. The terminals 34 are positioned so that the contact portions 43 bear against the preload ribs 58 to impart a desired preload on the cantilevered spring arms 42.

FIG. 9*b* is a sectional view taken along line BB. As shown in FIG. 9*b*, the substrate 31 is essentially located in a vertical position by the rims 63 and 64. The overall thickness of the module 69 generally approximates the desired contact pitch of the finished connector. For example, if a 2.0 mm contact pitch is desired, and assuming a substrate thickness of 0.4 mm, the thickness of cover 56 would be approximately 1.6 mm. Thus, if the modules 69 are stacked in side by side relationship, the desired pitch is achieved.

As illustrated in FIG. 9*c*, each connector mounting 35 has its mounting portion received within a corresponding recess 60. If the board mounting terminal is of a type that is likely to have a relatively high axial force applied to it, such as a press-fit terminal, the surface 68 (FIG. 8*d*) of the recess 60 is advantageously located so that it bears against the upturned tang 52 of the terminal. The views in FIGS. 9*c* and FIG. 11 are taken substantially along section line CC of FIG. 9.

Figure 11:
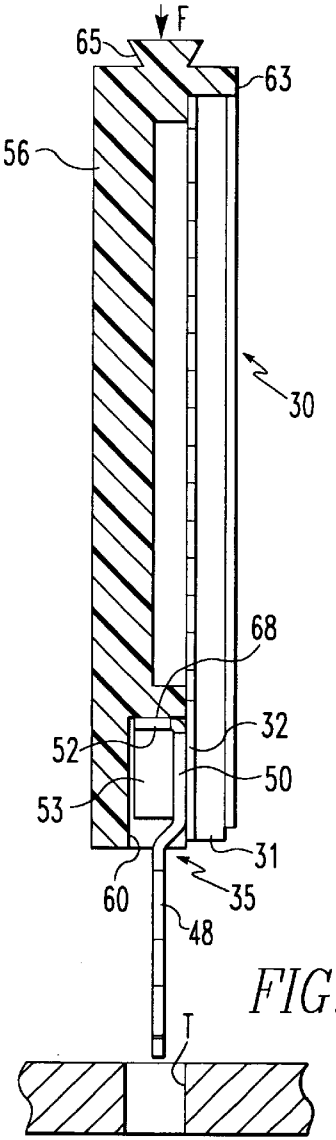
FIGS. 10, 10*a* and 11 are enlarged views showing portions of the integrated terminal module shown in FIG. 9.

FIG. 9*d* is a fragmentary cross sectional view taken along line DD of FIG. 9 showing a positioning of grounding terminal 37 in a similar fashion to terminal 35 in FIGS. 9*c* and FIG. 11.

FIG. 9*e* is a view of the back end of the module 69 showing in phantom views the locating boss 62 and the mounting portion of a terminal 35.

Figure 10A:
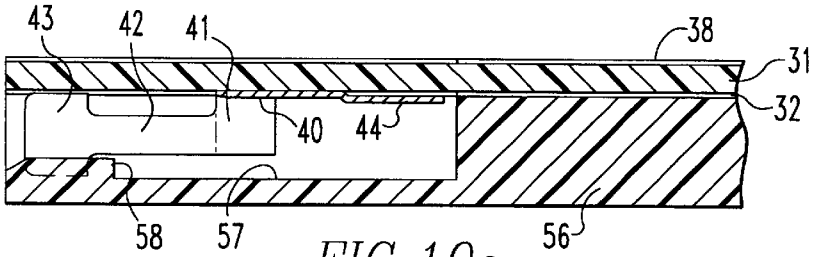
Figure 10:
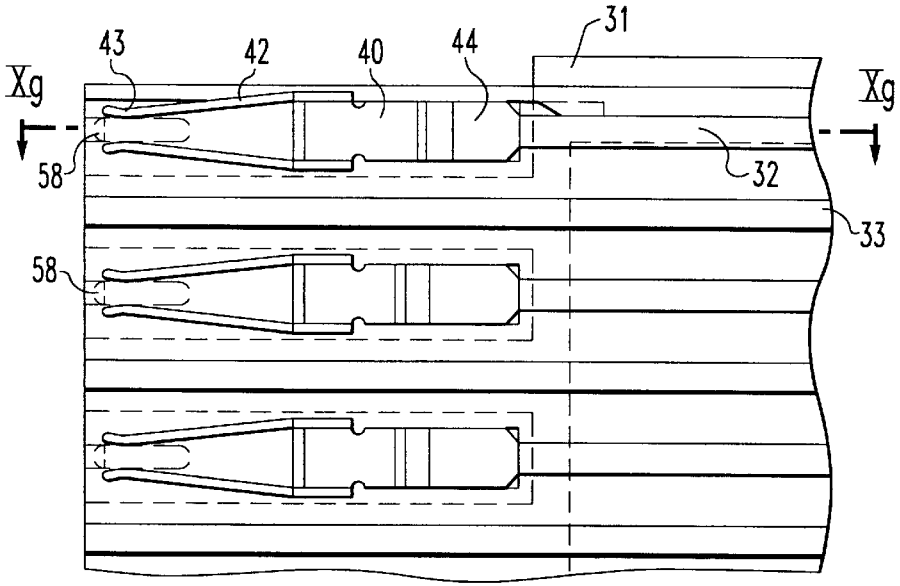

FIGS. 10 and 10*a* illustrate enlarged views of the connector contacts 34 located in recesses 57 of the cover 56. FIG. 10*a* is a cross sectional view taken along line GG of FIG. 10 and shows the positioning of the preload rib 58 with respect to the contact portions 43.

FIG. 11 illustrates the interaction of the cover 56 with the board connection terminal 35 when a downward force F is applied to the top edge of the module 69. That force is transmitted by the cover to the pressing surface 68 formed by the top surface of the recess 60. As a result, a vertical insertion force that is used to push the press-fit 48 into the hole T is applied directly to the upper tang 52 and the side tangs 53. In this manner, shear stress occuring at the solder connection between the base 50 of the terminal and the circuit trace 32 is minimized. In this manner, loosening or detachment of the terminal 35 is avoided. This is achieved, at least in part, by positioning the surface 68 so that it will engage tang 52 before the rim 63 beings applying a vertical force to the upper edge of the substrate 31. One way to accomplish this is to provide an initial, small clearance between the rim 63 and the adjacent edge of substrate 31. Additionally, the cover is designed so that a significant proportion of the insertion force is applied directly to terminal 35 so that stress at the terminal/conductive track interface is minimized. The structure disclosed is designed to withstand required press-fit pin insertion forces of 35–50 Newtons per pin.

Figure 12B:
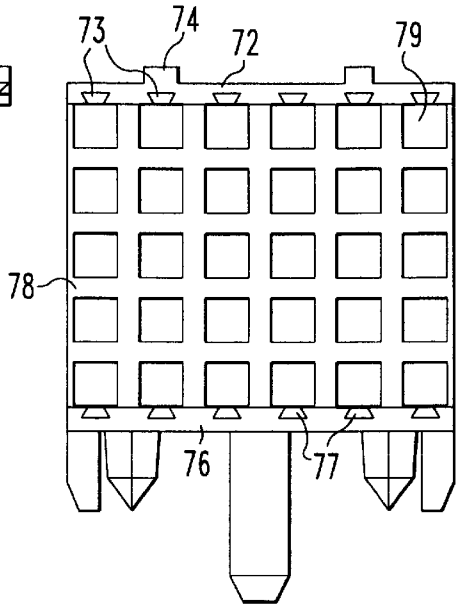
FIGS. 12–12*c* shown views of a connector housing for receiving a plurality of modules as illustrated in FIG. 9.
Figure 12:
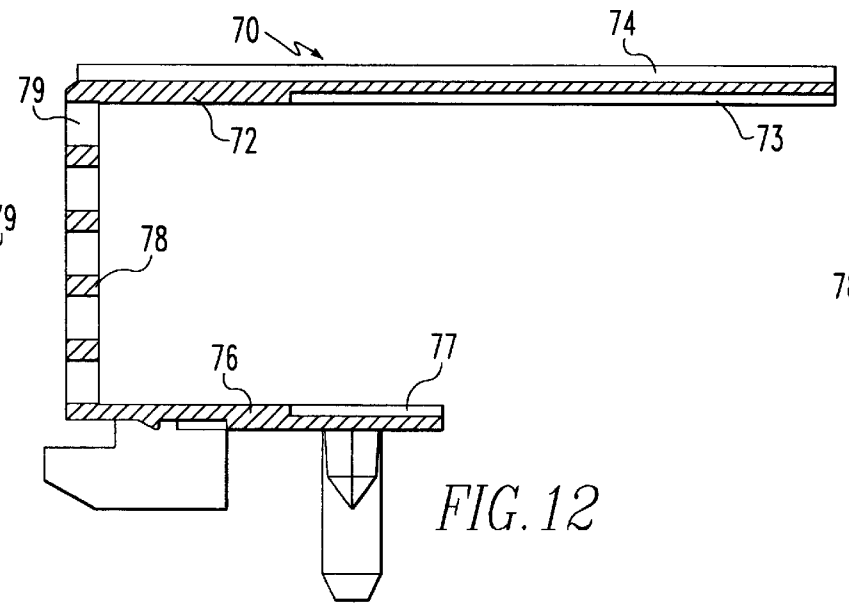
Figure 12A:
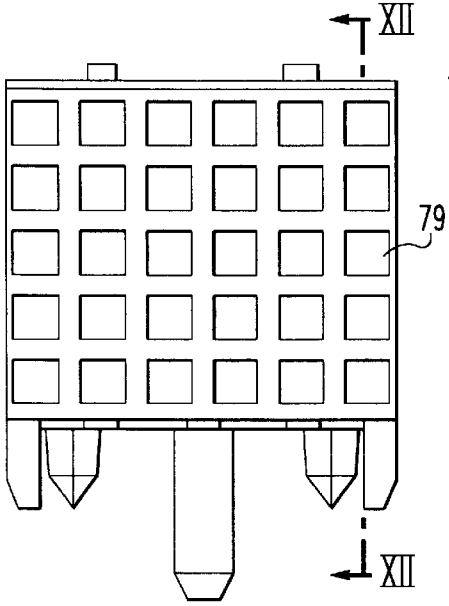
Figure 12C:
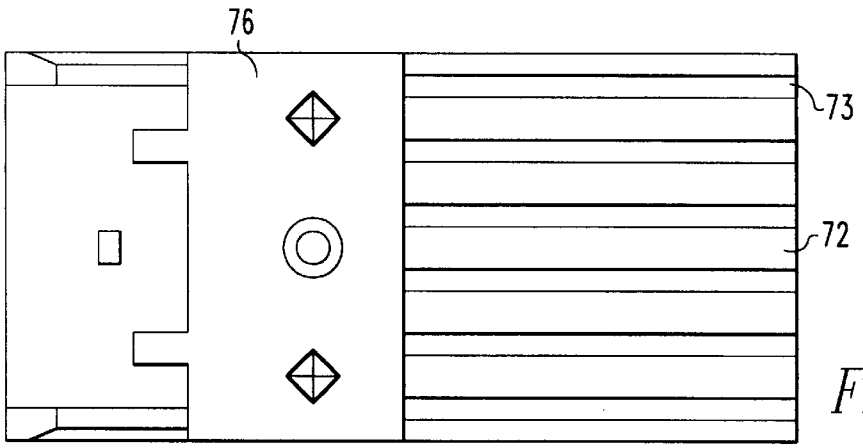

FIG. 12 is a cross sectional view taken along line HH of FIG. 12*a* and shows a connector housing 70 having a top wall 72, a bottom wall 76 and a front wall 78. The top wall 72 includes a plurality of locating slots, for example the dove tail slots 73. One or more guiding ridges 74 may be formed on a top surface of the top 72. The bottom 76 also includes a locating slot, for example the dove tail slots 77. The front wall 78 includes a plurality of openings 79.

Figure 13:
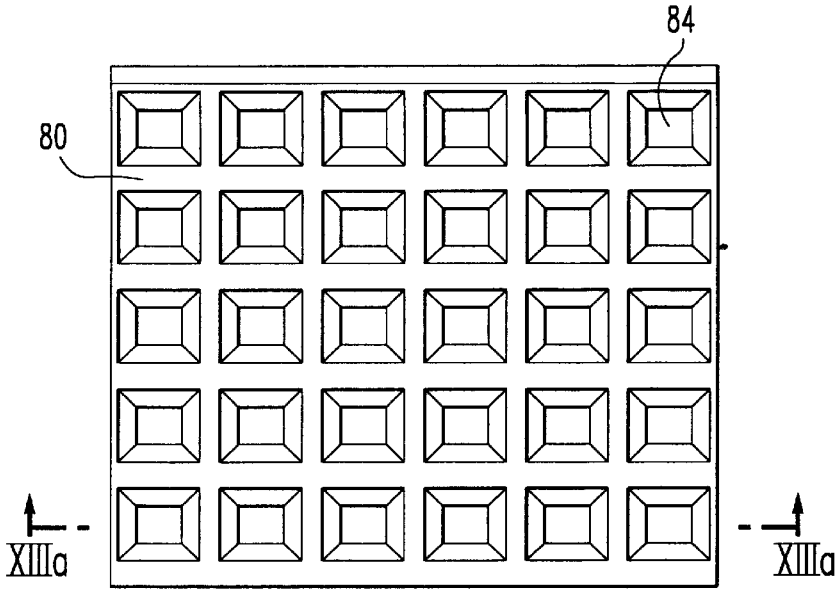
FIGS. 13, 13*a* and 13*b* show various views of a lead-in plate for the housing shown in FIG. 12.
Figure 13A:
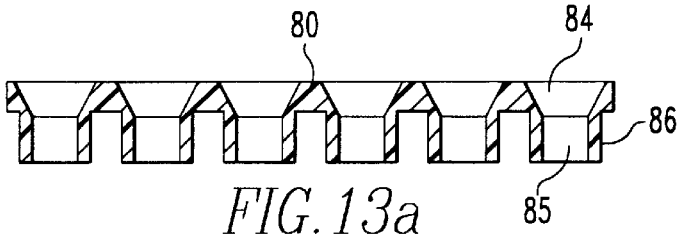
Figure 13B:
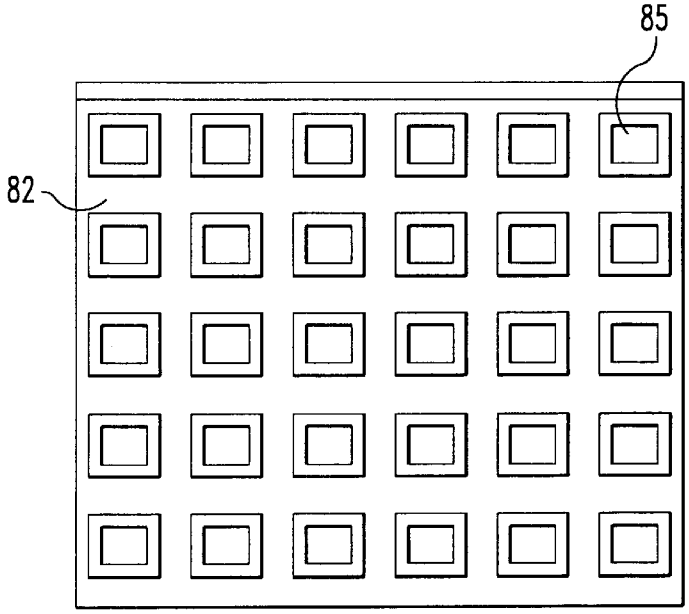

FIG. 13*a* is a front elevational view of a lead-in face plate 80 having a plurality of tapered lead-in sections 84 arranged in the form of a grid on a front surface 82 thereof. Each of the lead-in portions 84 extends to a pin insertion port 85. A plurality of sleeves or hollow bosses 86 extend from the rear surface of the face plate 80 and are shaped in size to be positioned in the openings 79 in the front wall 78 of housing 70.

Figure 14B:
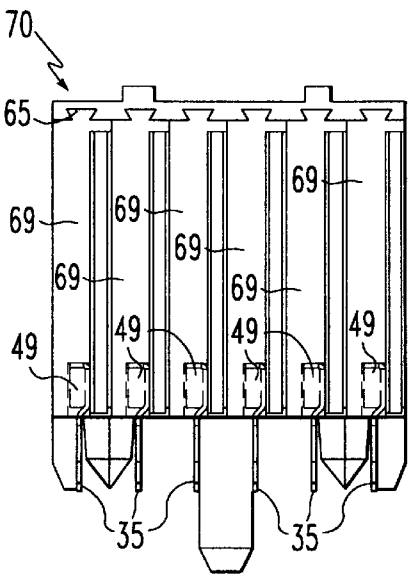
FIGS. 14–14*c* show views of a completed connector assembly.
Figure 14:
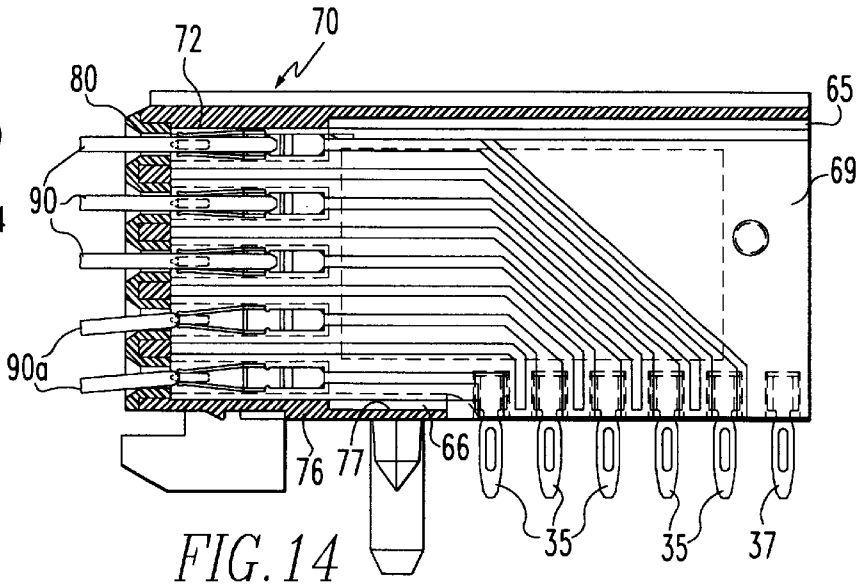
Figure 14C:
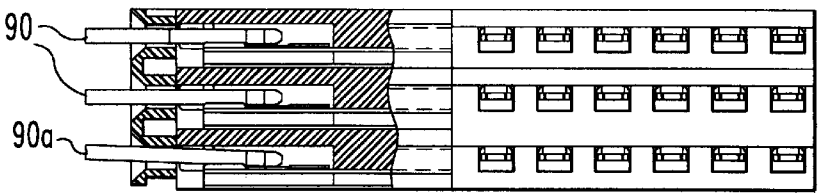
Figure 14A:
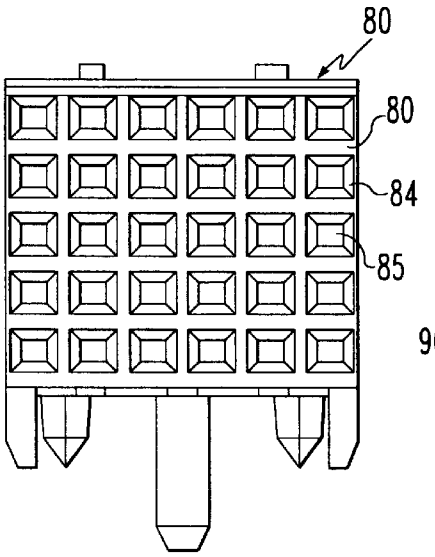

FIG. 14 is a sectional view showing the assembly of contact module 69, housing 70 and face plate 80 to form a completed right angle connector. A plurality of pins 90 and 90*a* are shown being received in the mating contact terminals 34. The pins designated as 90*a* in both FIGS. 14 and 14*c* are shown in a somewhat misaligned, as can occur when pins are bent. As shown in FIG. 14*b*, in order to form a finished connector, a plurality of contact modules 69 are assembled in the housing 70 by aligning the dove tail ribs 65 and 66 of each module with the dove tail slots 73 and 77 respectively of the housing and pushing the modules in the direction of front wall 78. The mounting contacts 33 and ground contact 37 are positioned to be inserted into the holes of a circuit board on to which the connector is to be mounted. This would conventionally be accomplished by applying a downward force, usually to the top of the housing 70 extending over the region of the board contacts 35.

Additional shielding can be provided by metallizing appropriate surfaces of the housing 70.

The foregoing constructions yield connectors with excellent high speed characteristics at low manufacturing costs. Although the preferred embodiment is illustrated in the context of a right angle press-fit connector, the invention is not so limited and the techniques disclosed in this application can be utilized for many type of high density connectors systems wherein signal contact are arranged in rows and columns.

What is claimed is:

1. A connector, comprising at least one PCB assembly comprising an insulating substrate and a spacer layer mounted next to the substrate, said insulating substrate having at least one conductive trace on a first surface, each of said conducting traces having a first end, a first contact terminal mounted on the first end, a second end, a second contact terminal mounted on the second end, the spacer having a first recess for accommodating at least part of the first contact terminal and a second recess for accommodating at least part of the second contact terminal.

2. A connector according to claim 1, wherein said spacer includes a cover plate made of insulating material, said cover plate having at least one conductive trace on a first cover plate surface facing said insulating substrate, said conducting trace on the cover plate having one end for connection to the first contact terminal and another end for connection to the second contact terminal.

3. A connector according to claim 1, wherein ground traces are provided on the surface of the insulating substrate carrying the conductive trace and a ground layer is disposed on a second opposed surface of the insulating substrate, the ground trace and ground layer being electrically connected through at least one plated through hole.

4. A connector according to claim 1, wherein said second contact terminal includes structure for connecting the connector to a printed circuit board.

5. A connector according to claim 1, and further comprising an insulating connector body for receiving said PCB assembly.

6. A connector according to claim 1, and further comprising at least one electrical filtering component associated with the conductive trace on the insulating substrate.

7. An electrical connector comprising:

an insulative substrate having a first exterior surface and at least one circuit trace disposed on the first surface and extending from a first area of the substrate to a second area of the substrate, the circuit trace including at least a first location for mounting an electrical terminal on the substrate in electrical connection with the circuit trace; and a first electrical terminal, the first terminal having a mounting section for mounting the terminal at the first location on the circuit trace and a contact section disposed in offset relation to the first surface, for establishing electrical connection with a mating contact.

8. An electrical connector as in claim 7, wherein at least a portion of the contact section of the terminal extends beside the first surface of the substrate.

9. An electrical connector as in claim 7, wherein at least a portion of the contact section of the terminal extends beyond an edge of the substrate.

10. An electrical connector as in claim 7, wherein the mounting section is adapted to be surface mounted at the first location.

11. An electrical connector comprising:

a circuit substrate having a first surface and at least one circuit trace disposed on the first surface and extending from a first area of the substrate to a second area of the substrate, the circuit trace including at least a first location for mounting an electrical terminal on the substrate in electrical connection with the circuit trace; and a first electrical terminal, the first terminal having a mounting section surface mounted to the substrate at the first location on the circuit trace and a contact section, said terminal including a force application structure adapted to receive a force applied to the terminal.

12. An electrical connector as in claim 11, wherein the force application structure comprises structure extending away from the first surface of the substrate.

13. The electrical connector of claim 11, wherein the terminal is a press-fit terminal.

14. An electrical connector as in claim 12, wherein the structure comprises a tab upstanding from the first surface.

15. An electrical connector as in claim 14, wherein the structure further comprises an upstanding member adjacent the tab.

16. An electrical connector as in claim 11, and further comprising an insulative cover for covering the first surface of the substrate, the cover and the substrate forming a module.

17. An electrical connector as in claim 16, and further comprising a housing, the housing including structure adapted to hold a plurality of said modules.

18. An electrical connector as in claim 17, wherein each module includes a plurality of circuit traces, each trace having a first location, with a contact terminal disposed at said first location of each circuit trace, and a second location spaced from the first location and a contact terminal disposed at each second location.

19. An electrical connector as in claim 16, wherein the cover includes structure adapted to engage said force application structure to apply said force thereto.

20. An electrical connector as in claim 19, wherein the structure comprises a surface adapted to bear against said force application structure.

21. An electrical connector as in claim 20, wherein the cover includes a recess for receiving the terminals and the surface comprises a wall of the recess.

22. An electrical connector as in claim 11, wherein the substrate includes a second surface opposite the first surface and a metallic shielding layer is disposed on the second surface with at least a portion of the metallic shielding layer overlying a shielding layer on the first surface, an opening extending through the substrate in said overlying region, said cover having a locating member extending into said opening.

23. The electrical connector of claim 22, wherein the opening is a plated through hole.

24. An electrical connector comprising:

an insulative substrate having a first surface and at least one circuit trace disposed on the first surface and extending from a first area of the substrate to a second area of the substrate, the circuit trace including at least a first location for mounting an electrical terminal on the substrate in electrical connection with the circuit trace;

a first electrical terminal, the first terminal having a mounting section for mounting the terminal at the first location on the circuit trace and a contact section, and wherein the contact section of the terminal includes a spring biased contact member;

a cover overlying the substrate and together with the substrate forming a module; and a preload element on the module for preloading the contact member.

25. An electrical connector as in claim 24, wherein the cover includes a recess for receiving the contact section of the terminal and the preload element comprises a rib located in the recess positioned to urge the contact member to a preload position.

26. An electrical connector module placeable in a connector housing, the module comprising:

an insulative substrate having a first surface and at least one circuit trace disposed on the first surface and extending from a first area of the substrate to a second area of the substrate, the circuit trace including at least a first location for mounting an electrical terminal on the substrate in electrical connection with the circuit trace; and a first electrical terminal, the first terminal having a mounting section for mounting the terminal at the first location on the circuit trace and a contact section; and an insulative cover disposed on the substrate, the cover including an elongate edge, said elongate edge including a projection for securing the module in the connector housing.

27. An electrical connector module as in claim 26, wherein said elongate edge of the cover defines a top edge of the module and the terminal is disposed along an edge of the substrate opposite said top edge.

28. An electrical connector module as in claim 27, in combination with the connector housing, the housing having a slot for receiving the projection.

29. An electrical connector comprising:

an insulative substrate defining a plane and having a first surface and a plurality of circuit traces disposed on the first surface and extending from a first portion of the substrate to a second portion of the substrate, each circuit trace including a first location in the first portion of the substrate for mounting one of a first series of electrical terminals on the substrate and a second location for mounting one of a second series of electrical terminals;

a series of first electrical terminals, each of the first terminals extending generally parallel to the plane and having a mounting section mounted at the first location on one of the circuit traces and a contact section disposed exteriorly of the substrate; and a series of second electrical terminals, each of the second terminals extending generally parallel to the plane and having a mounting section mounted at the second location on one of the circuit traces and a contact section disposed exteriorly of the substrate.

30. A connector as in claim 29, wherein the first terminals and second terminals are surface mounted on the substrate.

31. An electrical connector as in claim 30 and further comprising a cover mounted on the substrate and overlying at least a portion of the second surface, the cover and the substrate forming a contact module, the cover including structure adapted to secure the module in a connector housing.

32. The electrical connector according to claim 29, wherein the mounting section of each second terminal is surface mounted on the substrate and the contact section of each second terminal is a press-fit section.

33. An electrical connector as in claim 32, wherein at least one of the second terminals includes structure for receiving a force applied to the terminal in a direction generally aligned with the longitudinal axis of the press-fit section.

34. An electrical connector as in claim 33 and further comprising a cover mounted on the substrate, the cover having a member for applying a force to the force receiving structure of said at least one second terminal.

35. The electrical connector of claim 34, wherein said member comprises a surface of a recess formed in the cover for receiving said at least one second terminal, and said force receiving structure comprises a portion of the terminal upstanding from the substrate.

36. An electrical terminal for mounting on a circuit bearing substrate comprising:

a mounting section for surface mounting the terminal on the substrate, the mounting section including a mounting face adapted to be disposed against the substrate;

a contact section extending from the mounting section;

an upturned tang extending away from the mounting face; and a force application surface on said tang and spaced from said mounting face for receiving a force applied to the terminal in a direction generally parallel to the substrate.

37. A terminal as in claim 36, wherein the tang is disposed along an edge of the mounting section.

38. A terminal as in claim 37, wherein the terminal includes a second tang along another edge of the mounting section adjacent said upturned tang.

39. An electrical connector module, comprising:

a circuit substrate; and a terminal, including:

a contact section including a base, a pair of opposed contact arms extending from the base, the contact arms defining between them a contact mating axis, the mating axis being arranged substantially parallel to and offset from the substrate; and a mounting section extending from the base and secured to the substrate.

40. In a right angle electrical connector formed from a plurality of adjacently located modules, each module having mating contacts for engaging a corresponding mating connector and mounting contacts for engaging a substrate to which the electrical connector mounts, wherein the improvement comprises said modules each having a printed circuit board with conductive traces thereon, each conductive trace having one of said mating contacts and one of said mounting contacts surface mounted thereto.

* * * * *